United States Patent [19]

Becker

[11] 4,444,107

[45] Apr. 24, 1984

[54] PORTABLE LABELING MACHINE

[75] Inventor: Werner Becker, Hirschhorn, Fed. Rep. of Germany

[73] Assignee: Esselte Pendaflex Corporation, Garden City, N.Y.

[21] Appl. No.: 344,880

[22] Filed: Feb. 1, 1982

[30] Foreign Application Priority Data

Feb. 16, 1981 [CH] Switzerland ..... 996/81

[51] Int. Cl.[3] ..... B41J 5/00

[52] U.S. Cl. ..... 101/288; 101/291; 101/316; 400/167; 400/157.3; 400/435

[58] Field of Search ..... 101/288, 291, 292, 316, 101/93.02; 400/167, 435, 457, 169, 166, 57.3

[56] References Cited

U.S. PATENT DOCUMENTS

| | | | |
|---|---|---|---|
| 1,064,674 | 6/1913 | Visbruck | 400/457 |
| 3,143,064 | 8/1964 | Vann | 101/93.02 |
| 3,734,262 | 5/1973 | Doll et al. | 400/457 |
| 4,018,154 | 4/1977 | Matsumoto et al. | 101/93.02 |
| 4,149,462 | 4/1979 | Sato | 101/291 |
| 4,206,703 | 6/1980 | Sato | 101/291 |

FOREIGN PATENT DOCUMENTS

| | | | |
|---|---|---|---|
| 1524082 | 1/1970 | Fed. Rep. of Germany | 400/435 |

*Primary Examiner*—William Pieprz

*Attorney, Agent, or Firm*—Anthony J. Casella; Gerald E. Hespos

[57] ABSTRACT

The machine comprises a print table (8) and a print head (3) which are intended for the printing of characters on labels (11) borne by a continuous strip (10).

The print head (3) comprises a pusher (32), a lateral stop (29) and two detention notches (30, 31), and the print table (8) has a rotary cam (33) with return prism (34) and cocking spring (35), having three lifts (38).

Upon the typing, one lift is turned by the pusher (32) and the following lift comes laterally against the stop (29). When the print head rebounds, this lift engages in a notch (30) and holds the print head spaced from the print table.

This arrangement is provided to prevent a second printing of characters on the labels as a result of rebound. In a variant, the rotary cam is replaced by a reciprocating bolt.

6 Claims, 7 Drawing Figures

PORTABLE LABELING MACHINE

The object of the present invention is a portable labeling machine adapted to be operated with a single hand for printing selected characters on self-adhesive labels arranged one behind the other on a continuous strip and for detaching said strip and applying said labels, as they are printed, onto selected articles intended for sale.

Labeling machines adapted to carry out these operations are already known which, like the machine of the present invention, comprise a housing provided with a carrying handle, a printing unit located in said housing and having a printing head with type selector and a print table which are capable of coming together for the typing of selected characters, a step-by-step drive device driving a continuous label-bearing strip along a circuit passing over the print table, a lever-shaped trigger connected to the printing unit and to the step-by-step drive device to cause, upon each actuation, the typing of the selected characters on a label of the continuous strip and the advance of said strip, a device adapted to prevent a second printing on said label before release of the trigger, and a device for separating and dispensing the labels of the continuous strip out of the housing so as to permit their adhesive attachment to the articles to be labeled.

On the known labeling machines of this type, the presence of a device intended to prevent a possible second typing on the labels is based on the necessity of assuring the greatest possible sharpness of the printed characters so as to facilitate the reading thereof by the buyers as well as by the employees in charge of the billing, and thus avoid any confusion or loss of time.

Furthermore, this sharpness of the printed characters is indispensable on labeling chains equipped with an optical character verification system: so as not to interfere with the reading by the optical readers.

This sharpness of the printed characters depends on various phenomena, one of which in particular, namely rebound between the two elements of the printing unit, i.e., the table and the printhead, as a result of the typing has always raised a problem which is difficult to solve.

This rebound, when it takes place, gives rise to a second printing, resulting in a blackening or a ghosting of the characters.

Blackening or over-inking takes place when the second impression occurs at the same place as the first, and ghosting or shading takes place when the second imprint is accompanied or preceded by a shift in the label, the latter being due essentially to the vibrations generated by the rebound, and which may even cause imprints which are distinct from each other.

The causes of rebound are essentially of an elastic nature, both on labeling machines having a trigger which is assisted by uniform expansion pressure and on machines with direct trigger in which the pressure is directly a function of the pressure imposed by the hand of the operator.

It is finally known that over-inking is at times superimposed on the effects of the second printing which have just been described when the trigger is not immediately released after the printing and when, therefore, the printing pressure is maintained for too long after the striking, this being the case primarily with labeling machines having direct trigger.

Several solutions have been proposed in order to solve the problems caused by the rebound between the two elements of the printing unit, the number and diversity of these solutions making the importance of these problems evident.

These solutions employ both devices for the damping by inertia, elastic or friction of the striking which is effected by the coming together of the two elements of the printing unit in order to avoid the phenomenon of rebound by opposing it and devices for the elastic return of one of the two elements of the printing unit after the typing in order to prevent reprinting as a result of the rebound.

Mention may be made, by way of example of labeling machines equipped with damping devices, of those described in U.S. Pat. No. 4,010,682 and in DE-OS 28 04 295 and DE-OS 28 23 121.

Based on inertia or elastic systems, the damping devices of the labeling machines described in said three documents can fulfill their role only in the case of accelerations and pressures which are contained within a necessarily narrow range which is determined experimentally so as to cover, as well as possible, conditions of use which are considered "normal". Outside of said conditions, such as for instance upon rough use, the function desired becomes questionable. Furthermore, these devices cannot prevent over-inking by prolonged continuation of the printing pressure, since their anti-rebound function has precisely the effect of maintaining the print head and the print table against each other as long as the trigger is not released.

As reference mention may also be made, among labeling machines equipped with an elastic return device adapted to prevent reprinting as a result of rebound, of the one described in DE-OS 28 15 333 as well as those described in DE-OS 28 31 114.

The labeling machine described in the first of said two West German published patent applications, has an elastic return stop which yields to the printing impact but the elasticity of which is determined so as to prevent reprinting as a result of rebound, the pressure of which is assumed less than that of the said impact. The labeling machines described in the second German publication contain members of opposing elastic action which have the function, on the one hand, of bringing the print table towards the print head up to the moment of impact and of then immediately moving them apart.

Based also on elastic systems, the return devices of these labeling machines, which furthermore necessarily require mobility in operation of the print table, suffer from the same limitation as the preceding devices relative to the pressures and accelerations of use which are considered "normal" and outside of which the desired function becomes questionable. Furthermore, in the labeling machine described in DE-OS 28 15 333 there is nothing to prevent over-inking as a result of prolonged continuation of the printing pressure since the elastic stop of its return device is adapted to yield to this pressure. Finally, these devices require precise adjustment and are sensitive to wear, particularly those having members of opposing action, the reliability of which is a function of the precision of a dead-center point which separates these actions.

The object of the present invention is to avoid the above mentioned drawbacks of the prior art by providing a portable labelling machine equipped with a device capable of preventing, under all conditions of use, second printing as the result of rebound, and which is insensitive to the variations in pressure and accelerations in use, is of a simple structure which requires no precise adjustment and assures dependable and reliable operation, is capable of preventing over-inking as a result of prolonged continuation of the printing pressure, and is applicable to all types of portable labeling machines, whether they are of direct-trigger or assisted-trigger type and whether the print head and/or the print table are movable.

For this purpose, the portable labeling machine in accordance with the invention is characterized by the fact that the device intended to prevent a second printing comprises, on one side at least of the two elements of the printing unit, on the one hand a pusher, a lateral stop and at least one detent notch arranged on one of these two parts, and on the other hand, installed on the other part, a sequentially operating detent mechanism comprising at least one movable cocking control finger arranged in the path of the pusher so as to be actuated by the latter upon each striking, a cocking spring, a return member and a rigid spacing block which is subjected to the periodic sequential actions of the cocking control finger, the cocking spring and the return member, so as to be, in succession, and respectively, brought against the lateral stop at the time of the typing introduced below the detent notch as soon as the two elements of the printing unit are moved apart as a result of rebound, and freed from said notch upon release of the trigger respectively.

In this way all reprinting as the result of rebound is prevented in positive fashion by the presence of the rigid spacing block introduced between the print head and the print table immediately after said rebound. Likewise, no over-inking as a result of prolonged continuation of the printing pressure can occur, due to the fact that this spacing block is released only after the release of the trigger, at the time of the following typing.

The invention will be better understood together with its advantages, in accord with its purposes, from the following description and the accompanying drawing.

The drawing shows, by way of example, one embodiment of the object of the invention and a variant of the arrangement which characterizes it.

Figures 2, 4:
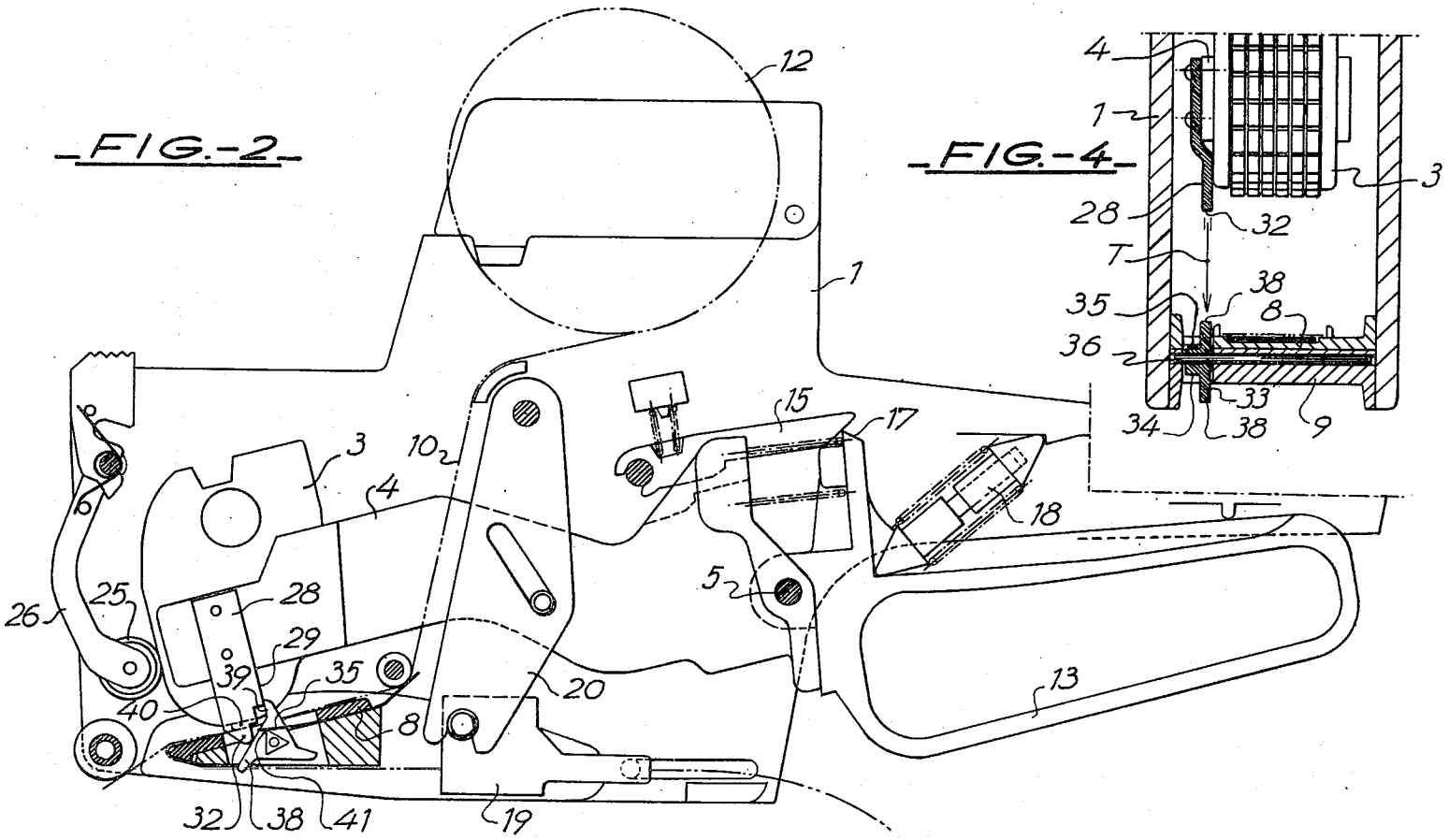
FIG. 4 is a partial section along the section line I-I of FIG. 1.
Figure 3:
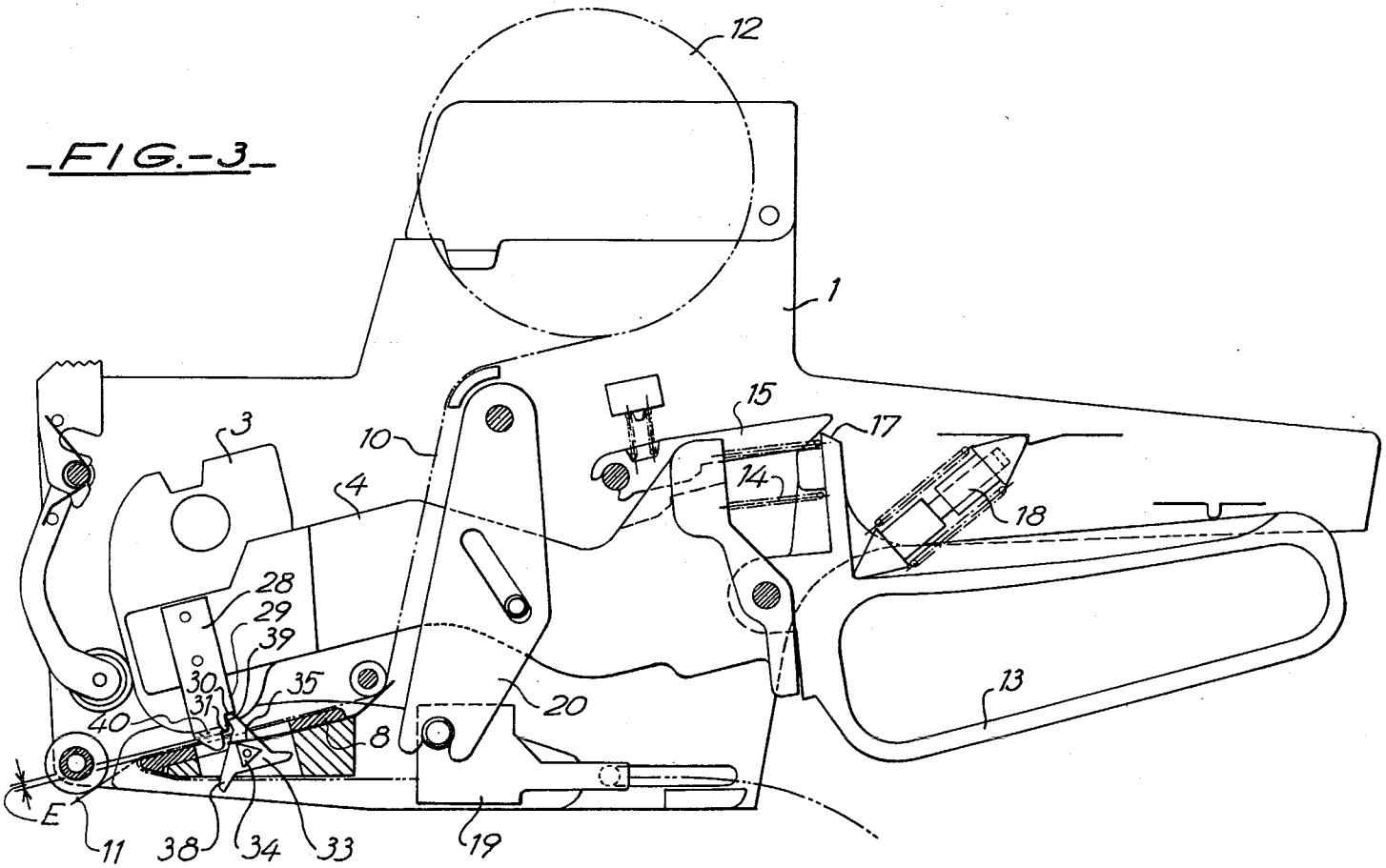

The portable labeling machine shown in FIGS. 1 to 4 comprises:

a housing 1 provided with a carrying handle 2 only the contours of which are shown in order not to needlessly complicate the drawing, a printing unit located in said housing and comprising a movable print head 3 with integrated rotary character selector, fastened to the end of a first lever 4 which is articulated on a first pivot 5 and comprises a drive finger 6 and a stop notch 7, and a print table 8 which is stationary in operation, supported by a support 9 which can be swung to the outside of the housing so as to permit the insertion of a continuous strip 10 of self-adhesive labels 11 coming from a roll 12 contained in the upper part of the housing 1, a lever-shaped trigger 13, articulated on said first pivot 5, of the type assisted with uniform expansion pressure, the combined action of which is assured by a cocking spring 14, a pawl 15 with return spring 16 which pawl is engaged in position of rest (FIG. 1) in the stop notch 7 of the lever 4, and, in this position, prevents the action of said spring, and a trip 17 which is integral with the trigger and intended to release said action by disengagement of the pawl 15 from the notch 7 (FIGS. 2 and 3). This trigger 13 is connected to the handle 2 by a spring separator 18 the purpose of which is to bring the assembly consisting of trigger 13, lever 4 and print head 3 into Position of rest (FIG. 1) at the time of its release, a step-by-step drive device 19 for the continuous strip 10, actuated by a second lever 20 articulated on a second pivot 21 and having an oblique slot 22 in which the drive finger 6 of the first lever 4 is engaged. This device 19, which is imparted one reciprocation upon each actuation and release of the trigger 13 has the known function of advancing the continuous strip 10 by a length corresponding to the width of one label;

a device for the separating and dispensing of the labels 11 which are borne by the continuous strip 10, formed by the association of an end 23, curved in the shape of a hairpin, of the print table 8 which has the function of separating the labels from the continuous strip, and by a pressing roller 24 which makes it possible to adhesively attach these labels by pressure by the machine on the article to be labeled;

a device for the inking of the printing type of the print head 3, consisting of a retractable inking roller 25 borne by a spring-return lever 26 articulated on a third pivot 27.

This mechanism is supplemented by a device intended to prevent a second printing of the labels by return of the print head as a result of the rebound described at the beginning of the specification. This device, comprises, referring in particular to FIGS. 1 and 4;

a part of steel plate 28 which is fastened on one side of the lever 4 bearing the print head 3 and the contour of which has a rounded lower end constituting a pusher 32, an edge forming a lateral stop 29 directed towards the print table 8 and two detention notches 30 and 31 staggered vertically and the detention faces of which are directed substantially towards the pivot 5 of the lever 4;

and a detent mechanism installed on the print table 8, consisting here of the assembly of a rotary cam 33 acting as rigid spacing block and of a polygonal Prism 34 concentric with said rotary cam and acting as return member, the angular contour of which cam is subjected to the pressure of a cocking leaf spring 35 fastened to the said print table.

The contour of the rotary cam 33 has three cocking control fingers consisting of three cam lifts 38 equidistant on its periphery and intended to be pushed in turn by the pusher 32 in counterclockwise direction. Each of these lifts 38 has an edge 39 forming a counter-abutment intended to come into contact with the stop 29 and to engage in at least one of the two detention notches 30 and 31 of the part 28. The prism 34, which is rigidly secured to the rotary cam, has three spring resting surfaces 35, each directed with respect to a lift 38 in such a manner that the said lift is in the path T of the pusher 32 in the position of rest shown in FIG. 1.

Figure 1:
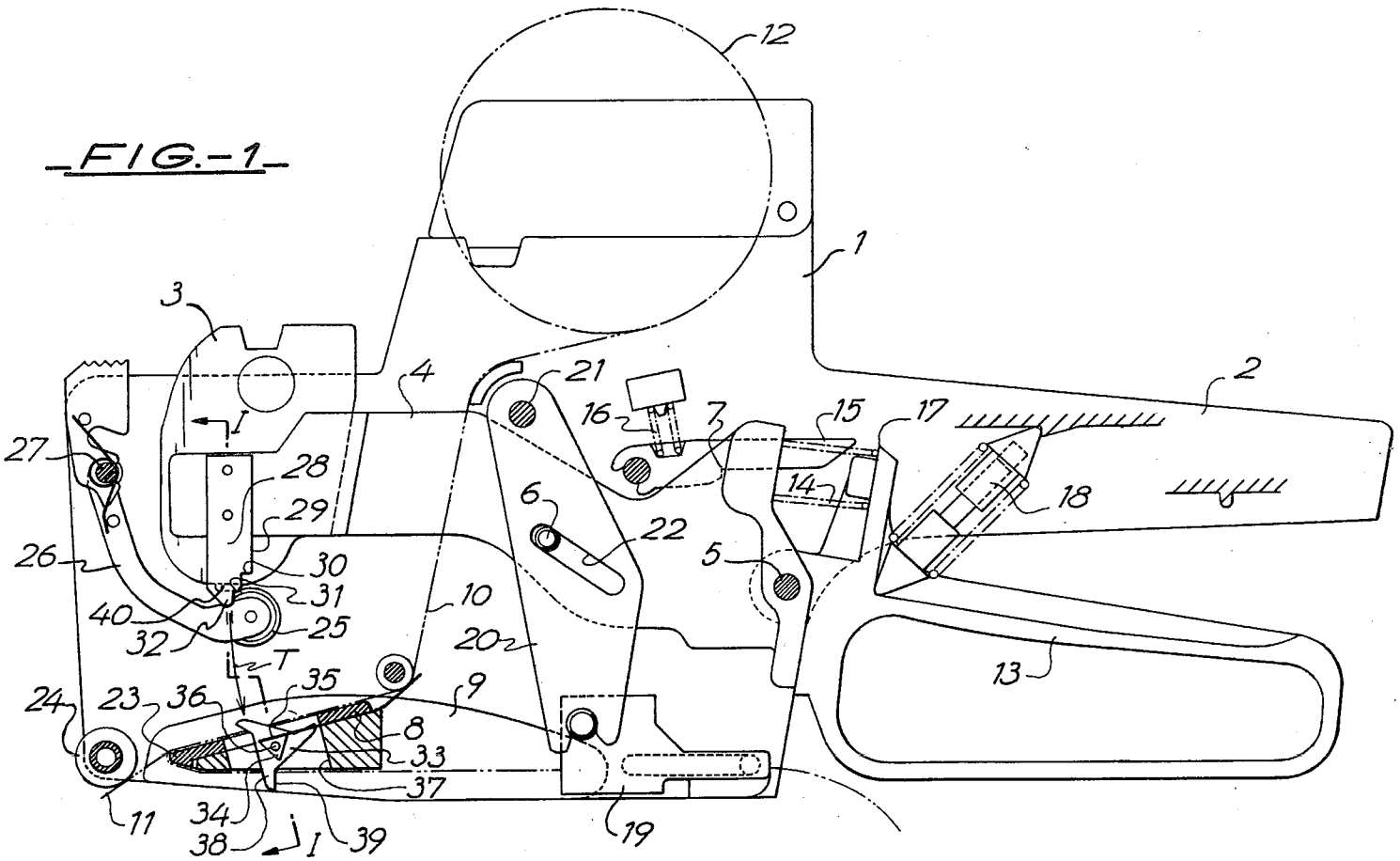
FIGS. 1, 2 and 3 are three overall views of the embodiment, showing three successive phases of its operation respectively.

The dimensional relationships of the different component parts of this detention device are dictated by the three principal phases of its operation, which are illustrated in FIGS. 1, 2 and 3.

The first phase, corresponding to the position of rest which is illustrated in FIG. 1, has already been described above and gives initial information with regard to the relative positions of the cam lifts, the pusher and the resting surfaces of the polygonal prism.

The second phase, which is illustrated in FIG. 2, corresponds to that of the printing stroke of the head 3 on a label of the continuous strip 10 passing over the print table 8, which stroke results from the actuating of the trigger 13. In this phase, the action of the assisted trigger 13 on the print head 3 and on the drive device 19 via the levers 4 and 20 is sufficiently easily understood from the drawing not to require further comment.

Attention may be called here to the fact that any other system of mechanical transmission having the effect of causing the striking and the advance of the label will not result in any change in the structure or in the operation of the members of the detention device which have just been described since they enter into relationship only with the print head and table and therefore this device can be applied with the same effects and advantages to each of these systems.

In this second phase, illustrated in FIG. 2, the encounter of the pusher 32 with a cam lift 38 as a result of the typing movement has just pushed this lever 38 until the printing characters 40 encounter the strip of labels 10 on the print table 8. The movement of rotation of the cam thus produced has the effect of bringing the counter-abutment 39 of the following cam lift against the stop 29 and of cocking the spring 35 by the action of the prism 34 so that, in this position, by the resting of the spring against an edge 41 defining two resting surfaces of the prism, the spring develops a thrust which has the effect of keeping the counter-abutment 39 pressed against the stop 29.

This phase shows that, in this relative position of the parts of the detention device, the edge 41 defining two adjacent resting surfaces of the prism must be shifted towards the left with respect to a line connecting the axis of pivot of the rotary cam with the point of contact between abutment 39 and stop 29 so that the spring 35 can develop the said thrust.

The following phase, which is shown in FIG. 3, corresponds to that of elastic rebound of the print head 3 on the print table 8 as a result of the typing.

During the lifting of the print head 3 caused by this rebound, the counter-abutment 39 of the cam lift, pressed by the action of the spring 35 against the stop 29, has slid along the latter and has engaged in the first detention notch 30. At this moment, if the trigger 13 is not yet released, which is generally the case due to the rapidity of the rebound phenomenon, the printing pressure developed by the cocking spring 14 pushes the print head 3 back towards the print table 8, but this movement is thus blocked in positive, i.e. non-elastic, manner by the said engagement of the counter abutment 39 of the cam in the retention notch 30.

In this phase, the vertical position of the detention notch 30 is defined as a function of the distance by which the cam lifts protude with respect to the print table and of a minimum spacing E between the characters 40 and the said print table which is sufficient to prevent a reprinting.

The second detention notch 31, located at a lower level, is provided as safety in case of exceptional rebound of large amplitude, in order to avoid an increase in the shock of the return impact against the first notch 30, but this second notch is not indispensable.

It will be easily understood that any prolonged continuation of the printing pressure has no effect on the retaining in spaced position of the print head since only the release of the trigger 13 has the effect of decocking it, returning the assembly of the parts of this device into the positions shown in FIG. 1, corresponding to the phase of rest. The only difference is that the cam will have made one-third of a revolution and will present its next lift 38 to the action of the pusher.

Due to the rigidity of the functional elements of this detention device, its operation is insensitive to any fluctuations in pressures and accelerations of use developed in the direction of the striking. Furthermore, the operation of the rotary cam 33 is also removed from the effects of any possible Pendulum accelerations due to the fact that, as a result of its regular contour, the center of gravity of this cam is located at its axis of rotation.

Finally, it may be pointed out that the absence of rebound, which would do away with the desired advantage of avoiding over-inking by means of prolonged continuation of the printing pressure, has not been considered since the invention is based precisely on the observation that this rebound phenomenon always takes place, whatever the type of labeling machine. This due to the elasticity of most of its operating members, such as in particular the printing characters and the tympan of the print table, which are made of rubber or of elastic synthetic material, and also due to the elasticity of the hand of the user.

Variants may be made in the embodiment of the detention device.

Among them mention may be made of:

The possibility of reversing the two elements of this device, that is to say of installing the part 28 on the print table and the rotary cam 33 on the print head 3.

The possibility of doubling this device, that is to say of installing another similar assembly on the other side of the print head and table, the second cam being mounted on the same shaft 36 as the first in order to compensate for any possible lack of natural or elastic transverse parallelism between these two elements in the case for instance of the selection of a very small spacing value E.

The possibility of increasing the number of cam lifts 38 and resting surfaces of the prism 34, depending on the selection of the diameter of the cam. The possibility also of imparting this prism a tooth-shaped concave polygonal contour.

The possibility of increasing the number of detention notches 30 and 31 of the part 28 depending on the amplitudes of the rebound observed on a particular type of labeling machine, or else, on the other hand, of limiting oneself to a single one of these detention notches.

Finally.there may be pointed out the possibility of designing a detention mechanism which assures the equivalent, provided that this mechanism has at least one pusher fastened to one of the two elements of the printing unit and at least one retractable rigid spacer block fastened to the other element, adapted to be disengaged and introduced sequentially between these two parts by the combined actions of the pusher and of a cocking spring upon each striking and each rebound.

Figure 5:
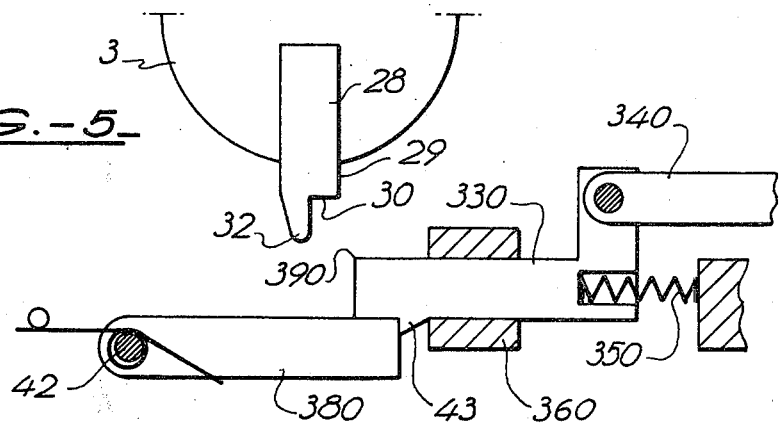
FIGS. 5, 6 and 7 are three partial views of the variant, showing three successive phases of its operation respectively.
Figure 6:
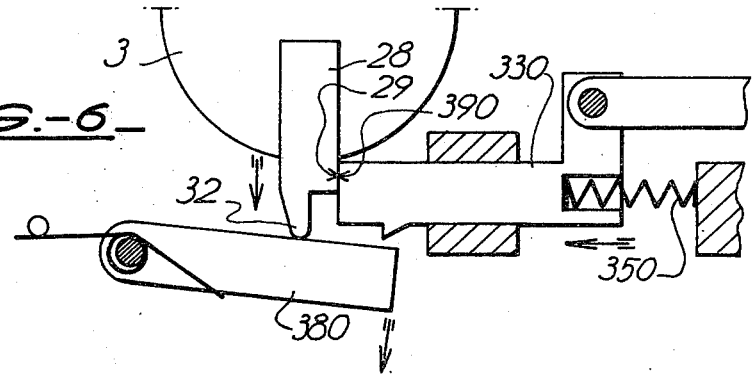
Figure 7:
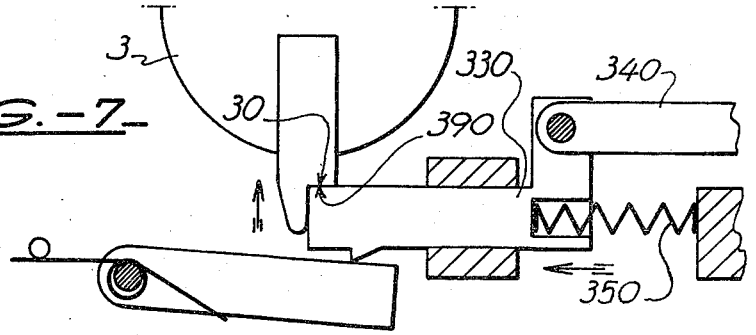

One variant of this type is shown in its three phases of operation in FIGS. 5, 6 and 7.

In this variant of the detention mechanism, the rigid spacing block consists of a reciprocatable bolt 330 instead of consisting of a rotary cam.

This detention mechanism comprises a cocking control finger consisting of a spring pawl 380 articulated on a shaft 42 borne by the print table (not shown), the bolt 330 in question mounted in a slot 360 of the print table and having a detention edge 43 opposite the spring pawl 380, and a rigid counter-abutment 390 opposite the detention notch 30 of a part 28 similar to that of the preceding example and fastened to the printhead 3, and also having a pusher 32 and a stop 29. The bolt 330 is subjected to the pressure of a coil cocking spring 350, and the return member of this mechanism consists of a connecting rod 340 connecting the bolt to a movable member which is subjected to the trigger, so as to be actuated at the end of the stroke of the latter. This connection, which has not been shown in order not to needlessly complicate the drawing, can be obtained, for instance, by means of a movement-reversing beam one arm of which is articulated to the connecting rod 340 and the other arm of which bears a trunnion engaged in a lengthned hole provided in the lower part of the lever 20 (FIGS. 1 to 3).

In the phase of rest shown in FIG. 5, the bolt 330 is shown spaced from the trajectory of the part 28 by the spring pawl 380 resting against the detention edge 43.

In the typing phase, shown in FIG. 6, the pawl 380, pushed by the pusher 32, swings and releases the bolt 330, which, due to the pressure of the cocking spring 350, places its conter-abutment 390 against the stop 29 of the part 28.

In the rebound phase shown in FIG. 7, the lifting of the print head 3 caused by this rebound permits the bolt 330 to engage via its counter-abutment 390, under the detention notch 30 by the action of the cocking spring 350 and thus to keep the print head spaced from the print table, as in the preceding example. At the end of the release stroke of the trigger, the connecting rod 340 returns the bolt 330 into position of rest, in accordance with the phase shown in FIG. 5.

I claim:

1. a portable labeling machine comprising a housing provided with a carrying handle, a printing assembly located in said housing, said printing assembly having a printhead with type selector and a print-platen adapted to meet each other for the typing of selected characters, stepping means for driving a continuous adhesive-backed label-bearing strip along a circuit passing over said print-platen, lever-shaped trigger means connected to said printing assembly and to said stepping means to cause upon each actuation thereof the typing of the selected characters on a label of the continuous strip and the advance of said strip, and means for separating the label from the continuous strip and dispensing the same towards the outside of the housing to permit adhesive attachment thereof to items to be labeled, the improvement of a device for preventing a second printing of characters on said label before release of the lever-shaped trigger means, comprising:

(a) at least one pusher, at least one stop, and at least one notch arranged on one of said printhead and print-platen;

(b) at least one rotary cam arranged for rotation by said pusher on the other of said printhead and print-platen;

(c) a plurality of fingers peripherally arranged on said rotary cam for selective sequential actuation by said pusher upon each typing and for successive movement against said stop and subsequently within said notch upon rotation of said rotary cam; and (d) spring means assembled to the other of said printhead and print-platen for selectively controlling the rotation of said rotary cam whereby upon each typing, the pusher encounters said finger and rotates the rotary cam until the following finger comes against the stop, whereby upon movement apart of said printhead and print-platen as a result of rebound the said following finger engages into the notch by action of the spring means on the rotary cam, and whereby upon release of the lever-shaped trigger means the spring means further rotates said rotary cam to withdraw the said following finger from said notch and present said following finger to the next action of the pusher.

2. In a portable labeling machine comprising a housing provided with a carrying handle, a printing assembly located in said housing, said printing assembly having a printhead with type selector and a print-platen adapted to meet eachother for the typing of selected characters, stepping means for driving a continuous adhesive-back label-bearing strip along a circuit passing over said print-platen, lever-shaped trigger means connected to said printing assembly and to said stepping means to cause upon each actuation thereof the typing of the selected characters on a label of the continuous strip and the advance of said strip, and means for separating the label from the continuous strip and dispensing the same towards the outside of the housing to permit adhesive attachment thereof to items to be labeled, the improvement of a device for preventing a second printing of characters on said label before release of the ever-shaped trigger means, comprising:

(a) at least one pusher, at least one lateral stop, and at least one notch arranged on one of said printhead and print-platen;

(b) at least one cam mounted for rotation on a shaft borne by the other of said printhead and print-platen;

(c) a plurality of cam lifts on said cam to form at least three peripheral cocking control fingers for selective sequential actuation by said pusher upon each typing;

(d) a counter-abutment on each of said cocking control fingers for successive movement against said lateral stop and subsequently within said notch upon rotation of said cam;

(e) at least one prism assembled to said cam, co-axially thereto, to form a polygonal contour having an edge corresponding to each of said cocking control fingers; and (f) cocking spring means also mounted on said other of said printhead and print-platen to exert a continuous resilient pressure on said polygonal contour, whereby upon each typing the pusher encounters a cocking control finger of the rotary cam and rotates it until the counter-abutment of the following cocking control finger comes against the lateral stop, whereby upon movement apart of said printhead and print-platen as a result of rebound the counter-abutment of the said following cocking control finger engages into the notch by pressure of the cocking spring means on the corresponding edge of said polygonal contour, and whereby upon release of the lever-shaped trigger means the cocking spring means by continued resilient pressure on said edge further rotates said cam to disengage the counter-abutment from said notch and present said following cocking control finger to the next action of the pusher.

3. A labeling machine according to claim 2, wherein one each of said at least one pusher, lateral abutment and notch are integral portions of a single part fastened to said one of said printhead and print-platen means.

4. In a portable labeling machine comprising a housing provided with a carrying handle, a printing assembly located in said housing, said printing assembly having a printhead with type selector and a print-platen adapted to meet each other for the typing of selected characters, stepping means for driving a continuous adhesive-backed label-bearing strip along a circuit passing over said print-platen, lever-shaped trigger means connected to said printing assembly and to said stepping means to cause upon each actuation thereof the typing of the selected characters on a label of the continuous strip and the advance of said strip, and means for separating the label from the continuous strip and dispensing the same towards the outside of the housing to permit adhesive attachment thereof to items to be labeled, the improvement of a device for preventing a second printing of characters on said label before release of the lever-shaped trigger means, comprising:

(a) at least one pusher, at least one stop, and at least one notch arranged on one of said printhead and print-platen;

(b) bolt means mounted on the other of said printhead and print-platen for reciprocal rectilinear motion towards and away from said stop and said notch;

(c) spring means for successively urging said bolt means towards said stop and said notch;

(d) spring biased pawl means articulated on said other of said printhead means and print-platen means for actuation by said pusher upon each typing;

(e) detention means for inter-locking said bolt means and said pawl means, said detention means being releasable upon actuation of said pawl means by said pusher; and (f) means for urging said bolt means against the bias of said spring means after release of said lever-shaped trigger means, whereby upon each typing the pusher releases the detention means to allow movement of the bolt means against said stop whereby upon movement apart of said printhead and print-platen as a result of rebound said bolt means engage into the notch, and whereby after release of the lever-shaped trigger means the bolt means are withdrawn from said notch and returned in inter-locked condition with said pawl means.

5. In a portable labeling machine comprising housing provided with a carrying handle, a printing assembly located in said housing, said printing assembly having a printhead with type selector and a print-platen adapted to meet each other for the typing of selected characters, stepping means for driving a continuous adhesive-backed label-bearing strip along a circuit passing over said print-platen, lever-shaped trigger means connected to said printing assembly and to said stepping means to cause upon each actuation thereof the typing of the selected characters on a label of the continuous strip and the advance of said strip, and means for separating the label from the continuous strip and dispensing the same towards the outside of the housing to permit adhesive attachment thereof to items to be labeled, the improvement of a device for preventing a second printing of characters on said label before ease of the lever-shaped trigger means, comprising:

(a) pusher, lateral stop, and notch defining integral portions of a single part fastened to one of said printhead and print-platen;

(b) bolt means mounted for reciprocal rectilinear movement towards and away from said lateral stop and said notch;

(c) slide means arranged on the other of said printhead and print-platen for guiding the movement of said bolt means;

(d) spring means to successively urge said bolt means towards said lateral stop and said notch;

(e) spring biased pawl means articulated on a shaft borne by said other of said printhead and print-platen for controlling movement of said bolt means and for rotational movement by said pusher upon each typing;

(f) detention edge means on said bolt means, said detention edge means being opposed to said pawl means for interlocking said bolt means and pawl means;

(g) connecting rod means connected to said bolt means and said lever-shaped trigger means for urging said bolt means against the bias of said spring means after release of said lever-shaped trigger means, whereby upon each typing the pusher pivots the pawl means against the bias of the spring and disconnects the pawl means from the detention edge means of the bolt means to allow spring biased movement thereof against said lateral stop, whereby upon movement apart of said printhead and print-platen as a result of rebound, said bolt means is further spring urged to engage into said notch, and whereby after release of the lever-shaped trigger means the bolt means is urged against the bias of the spring means to withdraw from said notch and return in inter-locked condition with said pawl means.

6. In a portable labeling machine comprising a housing provided with a carrying handle, a printing assembly ocated in said housing, said printing assembly having a printhead with type selector and a print-platen adapted to meet each other for the typing of selected characters, stepping means for driving a continuous adhesive-backed label-bearing strip along a circuit passing over said print-platen, lever-shaped trigger means connected to said printing assembly and to said stepping means to cause upon each actuation thereof the typing of the selected characters on a label of the continuous strip and the advance of said strip, and means for separating the label from the continuous strip and dispensing the same towards the outside of the housing to permit adhesive attachment thereof to items to abeled, the improvement of a device for preventing a second printing of characters on said label before release of the lever-shaped trigger means, comprising:

(a) rotary cam means mounted on one of said printhead and print-platen for rotational movement relative thereto;

(b) a plurality of finger means peripherally arranged on said rotary cam means for selectively controlling rotational movement of said rotary cam means;

(c) spring means assembled to said one of said printhead and said print-platen for further selectively controlling rotation of the rotary cam means;

(d) pusher means mounted on the other of said printhead and said print-platen for sequentially contacting one said finger and causing rotational movement of said rotary cam means upon each typing of said portable labeling machine;

(e) stop means mounted on the other of said printhead and said print-platen for stopping rotational movement of said rotary cam means after each typing of said portable labeling machine;

(f) notch means mounted on the other said printhead or print-platen for engaging a following said finger means after the typing of said portable labeling machine whereby upon each typing the pusher means encounters one said finger means and rotates the rotary cam means until the following finger means contacts against the stop means thus stopping rotational movement of the rotary cam means, and, whereby upon movement apart of said printhead and print-platen as a result of rebound said following finger means engages into the notch means by action of the spring means on the rotary cam means, and whereby upon release of the lever-shaped trigger means the spring means further rotates said rotary cam means to withdraw the said finger means from said notch means and present said following finger means to the next action of the pusher means.

* * * * *